US006321959B1

(12) United States Patent
Howell

(10) Patent No.: US 6,321,959 B1
(45) Date of Patent: Nov. 27, 2001

(54) LOW PROFILE SOCKET FOR BACKPACK

(75) Inventor: Frank A. Howell, Oxford, ME (US)

(73) Assignee: Down East, Inc., Bridgton, ME (US)

( * ) Notice: Subject to any disclaimer, the term of this patent is extended or adjusted under 35 U.S.C. 154(b) by 0 days.

(21) Appl. No.: 09/524,106

(22) Filed: Mar. 13, 2000

Related U.S. Application Data

(63) Continuation-in-part of application No. 09/133,798, filed on Aug. 13, 1998, now Pat. No. 6,079,602.

(51) Int. Cl.[7] ..... A45F 3/08
(52) U.S. Cl. ..... 224/262; 224/271
(58) Field of Search ..... 224/637, 262, 224/271, 272; 24/590

(56) References Cited

U.S. PATENT DOCUMENTS 5,004,135 * 4/1991 Dufournet et al. ..... 224/262
5,604,958 * 2/1997 Anscher ..... 224/272
5,620,120 * 4/1997 Tien ..... 224/199
5,622,296 * 4/1997 Pirhonen et al. ..... 224/272
5,729,869 * 3/1998 Anscher ..... 224/272
5,823,414 * 10/1998 Gal et al. ..... 242/262
5,850,954 * 12/1998 Joo ..... 224/272
5,850,996 * 12/1998 Liang ..... 224/272
6,006,969 * 12/1999 Kim ..... 224/272
6,079,602 * 6/2000 Howell ..... 224/271
6,098,858 * 8/2000 Laugesen ..... 224/197
6,161,741 * 12/2000 French ..... 224/272

* cited by examiner

*Primary Examiner*—Stephen P. Garbe
(74) *Attorney, Agent, or Firm*—Samuels, Gauthier & Stevens

(57) ABSTRACT

A low profile quick release assembly for securing and releasing a backpack frame to and from a waist belt which comprises a catch assembly adapted to be secured to the waist belt and a hook assembly adapted to be secured to the backpack frame. The catch assembly has laterally opposed guide surfaces extending downwardly and terminating in a retaining notch, at least one catch surface and a pivot radius formed in the retaining notch. The hook assembly comprises a front surface, a hook and at least one flexible finger having a catch surface formed in the hook assembly. The hook is spaced apart from the front surface to define therewith locating surfaces which terminate in a retaining radius. When the catch assembly and the hook assembly are engaged, the retaining radius seats on the pivot radius in contacting engagement and the catch surface engages the catch slot. The assembly disengages when the rearward angle of the backpack exceeds a predetermined angle with reference to vertical.

10 Claims, 9 Drawing Sheets

LOW PROFILE SOCKET FOR BACKPACK

CROSS-REFERENCE TO RELATED APPLICATION(S)

This application is a continuation-in-part application of U.S. patent application Ser. No. 09/133,798 filed Aug. 13, 1998, now U.S. Pat. No. 6,079,602.

BACKGROUND OF THE INVENTION

1. Field of the Invention

A socket assembly to support and release a backpack.

2. Discussion of the Relevant Art

Combat soldiers typically wear a light web-belt to carry often used items such as water-bottles, ammunition, and side-arms. The civilian equivalent to this is the "fanny-pack" popular with day hikers. Both soldiers and hikers, however, have difficulty wearing these light web belts when also wearing a heavy field backpack. Large load bearing backpacks use a substantial waist-belt to distribute the heavy load of the pack from the shoulders out over the wearer's hips. This waist-belt interferes with the web belt if both are worn at the same time. At best, it is inconvenient to move items from the light web belt to the heavy waist belt or visa versa depending on the moment's need. Combat soldiers and serious mountain climbers have the added concern of being able to quickly drop their large backpacks if suddenly threatened by enemy fire or natural dangers such as avalanches. If essentials such as ammunition and survival gear are on the backpack waist-belt they would be lost just when most needed.

The parent application addressed the problem of quick removal of a backpack from a waist belt. That disclosure teaches a backpack frame with a depending probe. The waist belt carried a socket. The socket extends outwardly from the belt approximately 2 inches. After donning the backpack the probe seats in the socket. If the backpack must be quickly disengaged, the straps holding the backpack to the soldiers body are released, the backpack rotates rearwardly and disengages. In field conditions, it was found that donning of the backpack was not as quickly effected as desired. The weight distribution of the backpack across the waist belt was not completely uniform and in some instances, the lateral movement of the backpack in the socket was a little loose.

BRIEF SUMMARY OF THE INVENTION

The catch/hook (socket) assembly described herein facilitates donning of the backpack, improves the load distribution on the waist belt and improves the lateral stability of the backpack/waist belt.

Broadly the invention comprises a waist belt equipped with a catch assembly secured to a belt insert. A mounting hook assembly is secured to a backpack frame. While wearing the waist belt, the user may shoulder a backpack and easily connect it to his/her waist-belt by inserting the backpack frame's hook assembly into the catch assembly.

When the waist-belt and backpack are locked together by the inventive system and the waist-belt is supporting the backpack, the system enhances comfort by allowing the backpack to pivot fore and aft in relation to the waist-belt as the wearer walks or flexes at the torso. While being worn, the backpack can be rapidly detached from the waist-belt by either releasing quick release buckles on shoulder straps or by slipping off the backpack's shoulder straps and allowing the backpack frame to rotate backwardly in the belt insert's catch assembly. Once the pack frame exceeds a critical backward angle, the hook assembly disengages from the catch assembly and the backpack separates from the waist-belt. The wearer is freed from the backpack, but retains the waist-belt and its attached gear.

In a preferred embodiment, the invention comprises a low profile quick release assembly for securing and releasing a backpack frame from a waist belt. A catch assembly is secured to the waist belt. The catch assembly has opposed surfaces extending downwardly and terminating in a retaining notch. A pivot radius is formed in the notch. Also, catch slots are formed in the assembly.

A hook assembly is secured to a backpack frame. The assembly has a hook extending inwardly toward the catch assembly and a depending tongue. The hook and tongue defining guide surfaces, said surfaces extending upwardly and terminating in a retaining radius. The assembly has at least one flexible finger having a catch surface.

When the assemblies are engaged, the retaining radius seats on the pivot radius in contacting engagement. The catch surfaces engage the catch slots. When the rearward angular backpack (hook) assembly exceeds a predetermined angle with reference to vertical, the assemblies disengage releasing the backpack.

In a particularly preferred embodiment of the invention, catch cups are secured to the belt insert laterally on either side of the catch assembly. Bumpers are secured to the backpack frame laterally on either side of the hook assembly. When the assemblies are engaged, the bumpers seat in the cups both to enhance the lateral stability of the backpack frame and to distribute the weight of the backpack across the belt insert.

DESCRIPTION OF THE PREFERRED EMBODIMENT(S)

Figure 1:
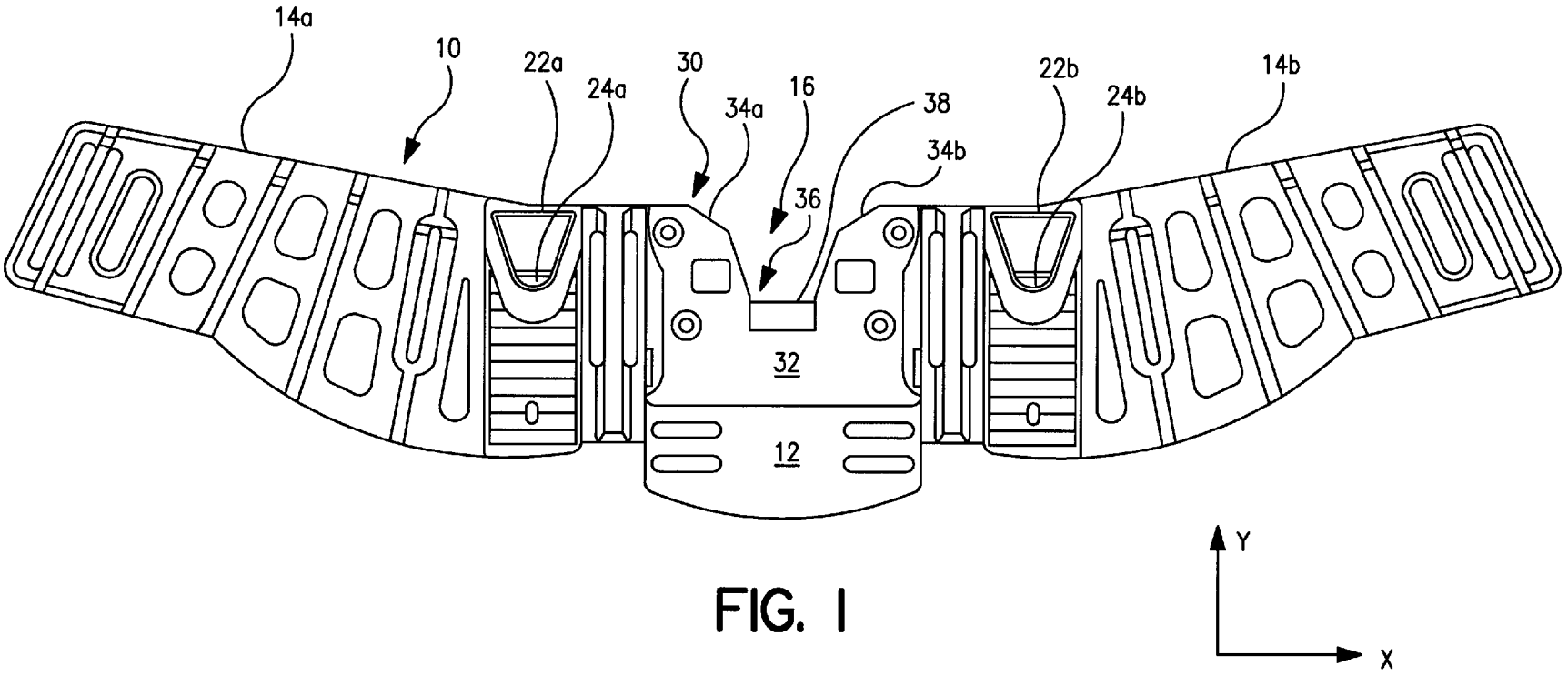
FIG. 1 is a rear view of a belt insert/catch assembly embodying the invention.
Figure 3:
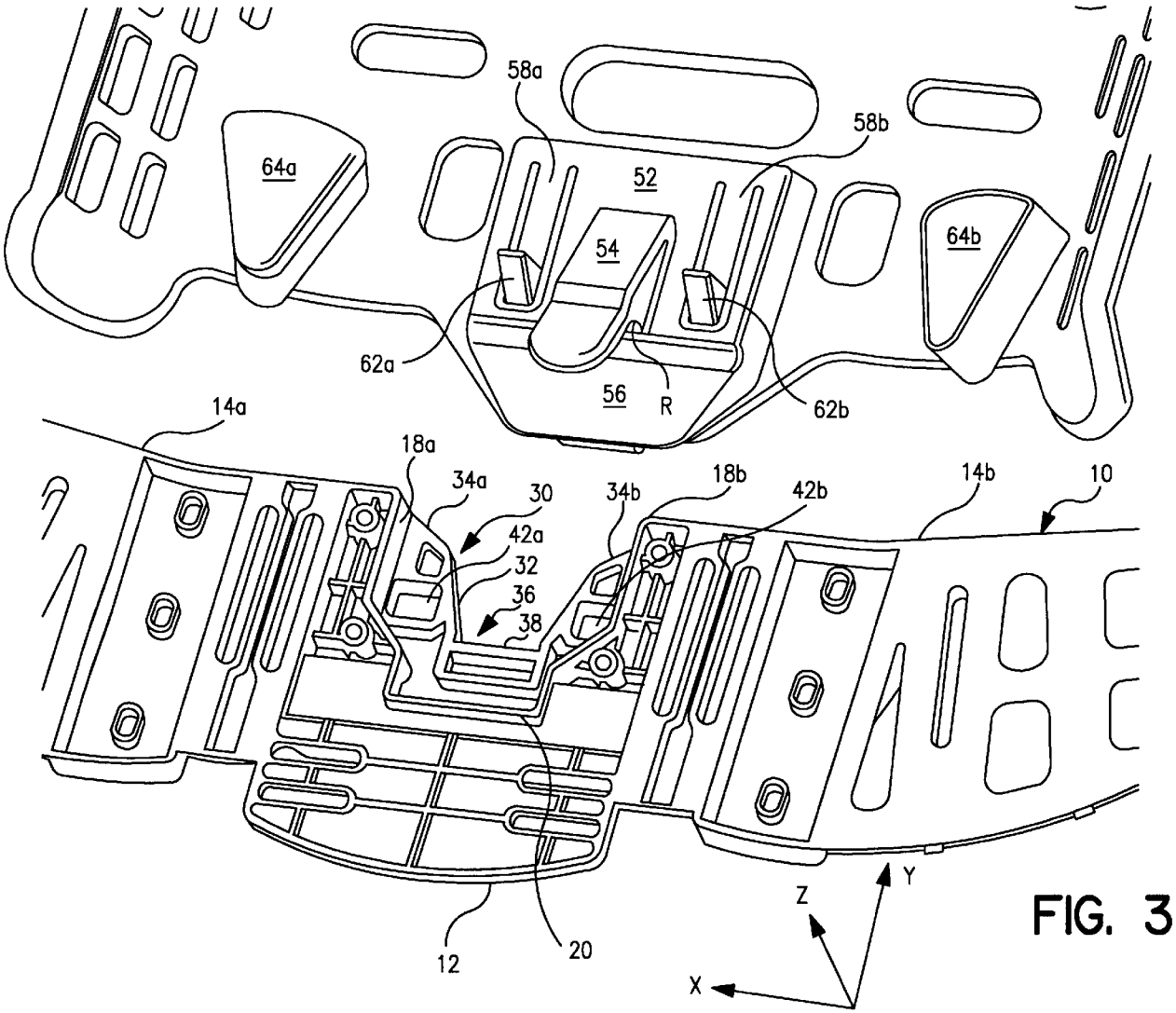
FIG. 3 is a perspective front view of a catch assembly/hook assembly and bumpers secured to a backpack frame and a catch assembly secured to a waist belt.
Figure 4:
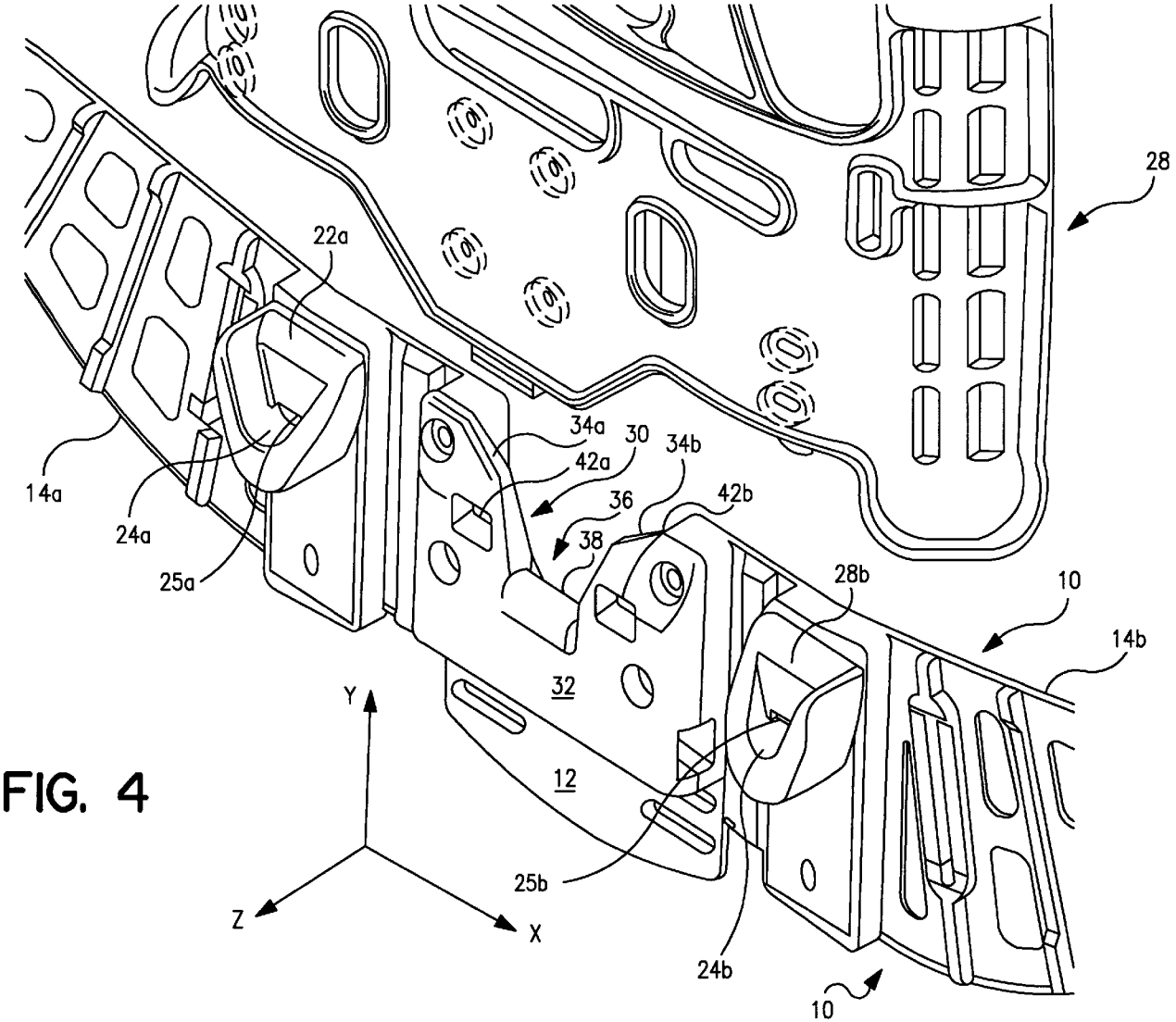
FIG. 4 is a perspective back view of FIG. 3.
Figure 5:
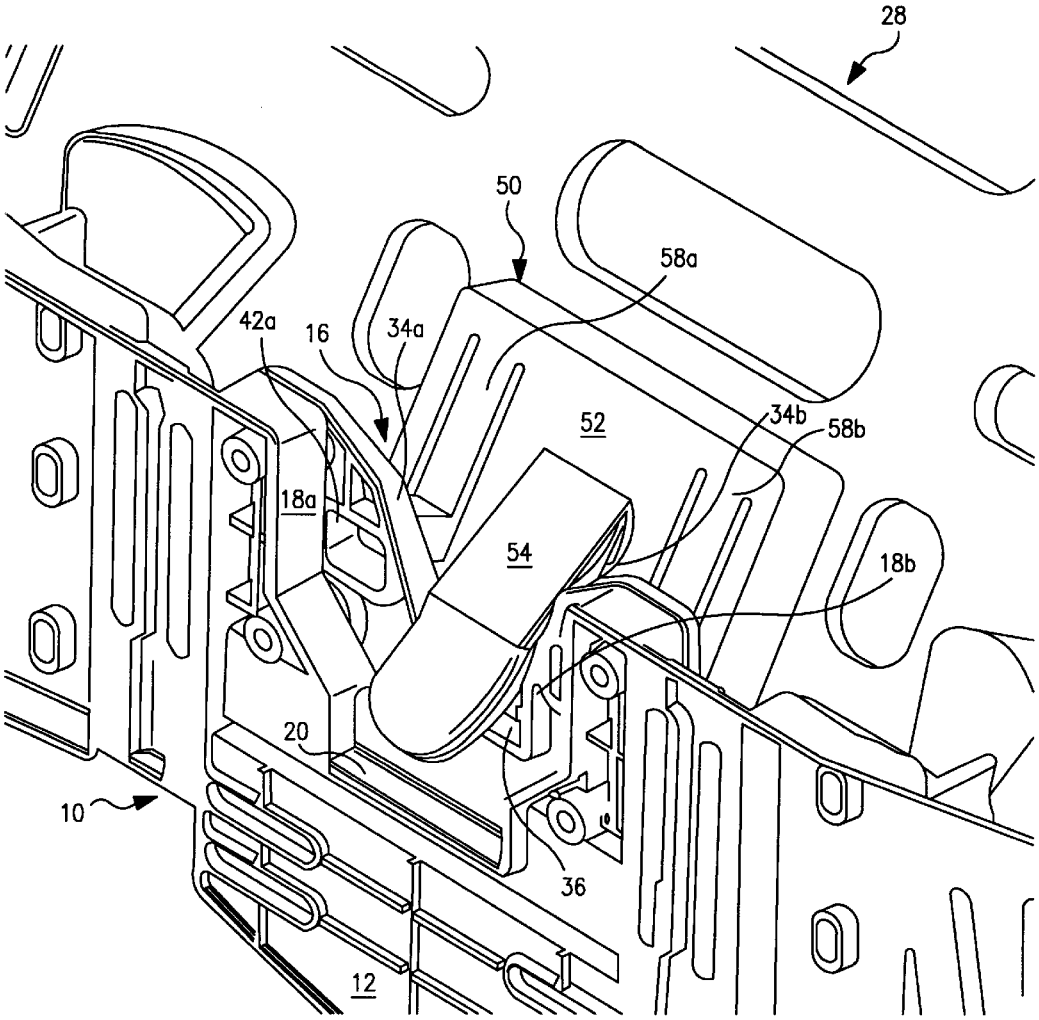
FIG. 5 is a perspective front view of the hook and catch assemblies just prior to engagement.

Referring to FIGS. 1, 3 and 4, a molded belt insert 10 is shown together with a catch assembly 30. A prior art waist belt to which this insert 10 is secured is shown in International Application PCT/US97/21188. The insert 10 comprises a backplate 12 and extending laterally therefrom are mirror image wings 14*a* and 14*b*. These wings 14 are adapted to be received in fabric sleeves on a waist belt (not shown). Referring to FIGS. 3 and 5, the backplate 12 has an opening 16 defined by opposed walls 18*a* and 18*b*, their lower ends terminating in a floor 20.

Referring to FIGS. 3, 4, 7 and 8, the catch assembly 30 is shown in greater detail. The catch assembly 30 comprises a support plate 32 which is secured to the back plate 12 of the insert 10 by fasteners (not shown). The support plate 32 has hook guiding surfaces 34*a* and 34*b* and a retaining notch 36 extending downwardly and terminating at a pivot radius 38. The pivot radius 38 is shown in greater detail in FIG. 7. Also formed in the plate are catch slots 42*a* and 42*b*.

Referring to FIGS. 1 and 4, catch cups 22*a* and 22*b* are secured to the wings 14*a* and 14*b* as shown. These cups 22 have recesses 24*a* and 24*b*. Located at the lower rear of the recesses 24*a* and 24*b* are vent ports 25*a* and 25*b*. These ports 25 allow mud and like debris to flow through and build up in the cups 22. The cups 22 can be secured to the wings 14 by any suitable means such as fasteners, rivots etc.

Referring to FIGS. 2, 3, 4 and 7, a prior art back pack frame 28 is shown. Secured to the frame 28 is a hook assembly 50 and bumpers 64*a* and 64*b*. The hook assembly 50 comprises a box-like support plate 52 fastened in any suitable manner to the bottom of the pack frame 28. A hook 54 extends outwardly and downwardly from the support plate 52. Depending from the support plate 52 and at least partially opposed to the depending hook 54 is a locating surface 56, the surface 56 and the opposed surface of the hook 54 function as guide surfaces defining a retaining radius, R, shown in bold, see FIG. 7.

Figure 2:
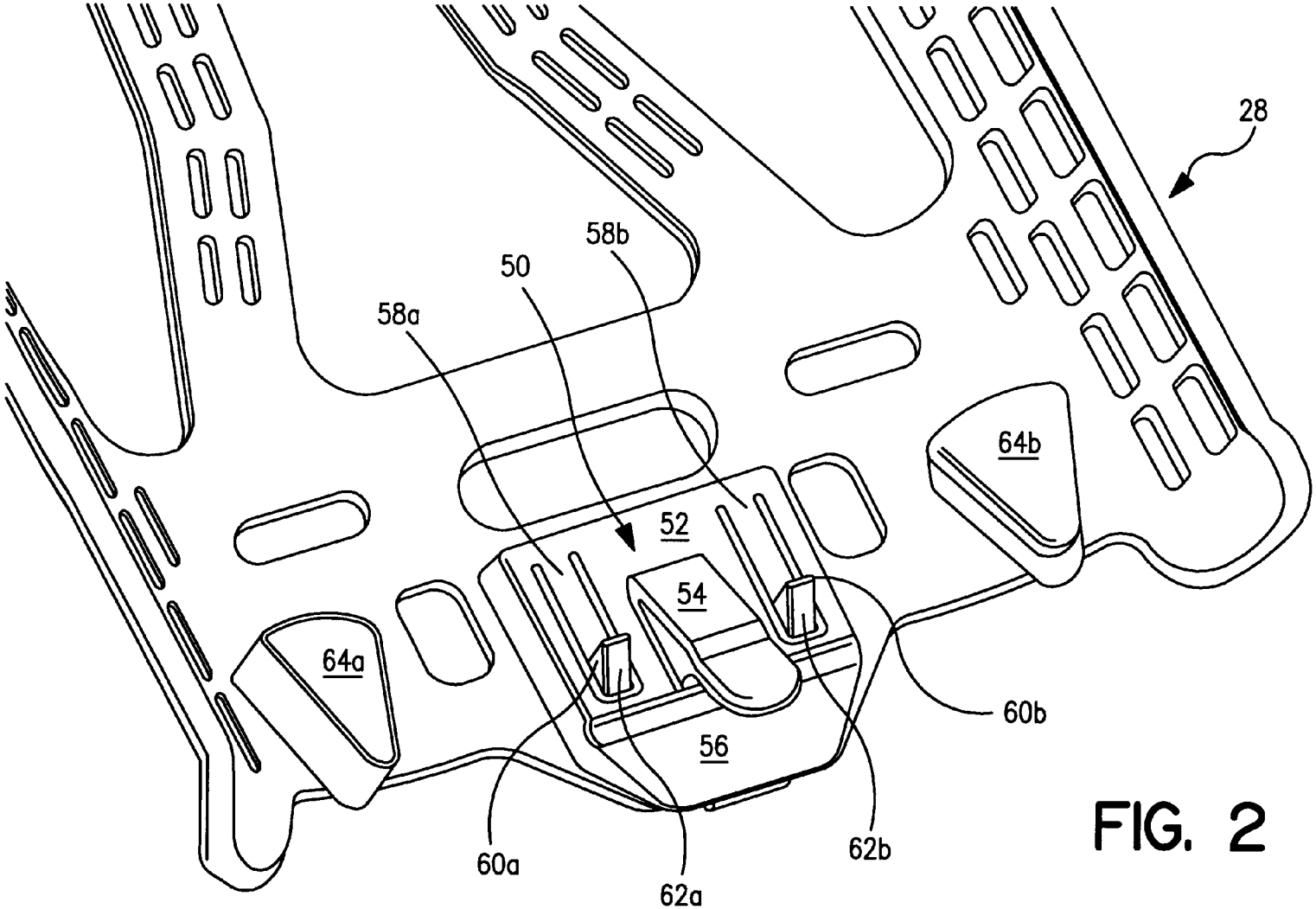
FIG. 2 is a front view of a belt insert/catch assembly embodying the invention.

Referring to FIG. 2, the hook assembly 50 is further characterized by a pair of flexible locking fingers 58*a* and 58*b* which terminate in catch surfaces 60*a* and 60*b*, and sloped surfaces 62*a* and 62*b*.

Figure 6:
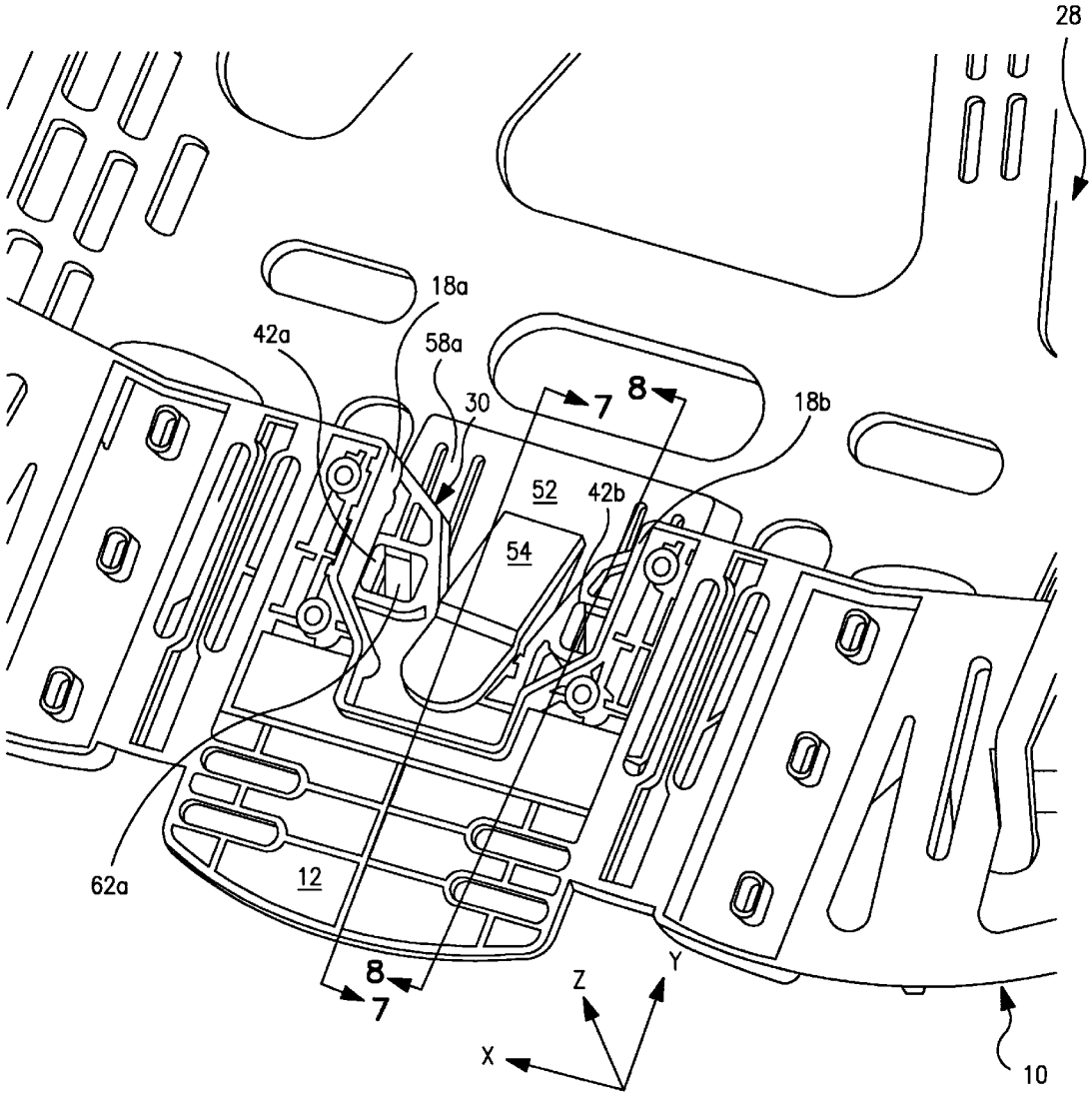
FIG. 6 is a perspective front view of the hook and catch assemblies just prior to engagement.
Figure 7:
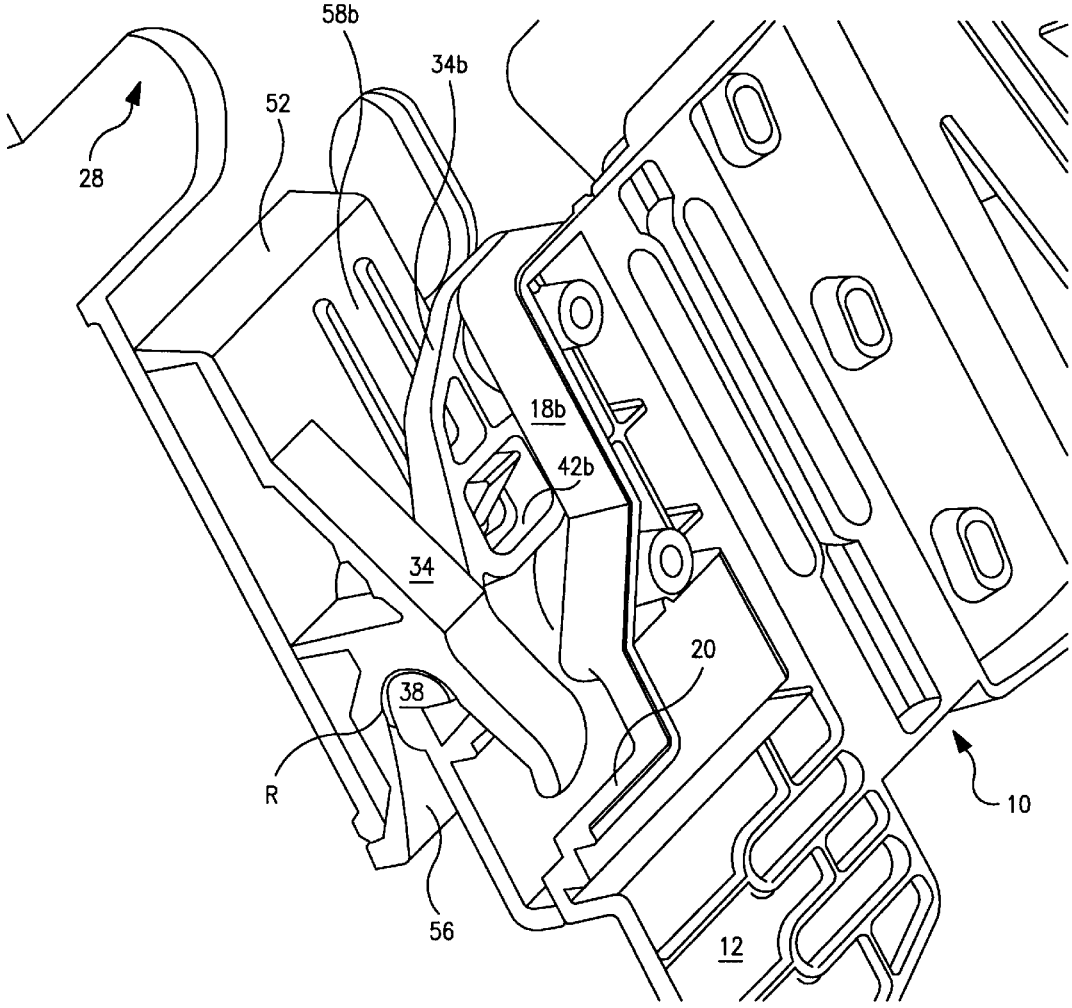
FIG. 7 is a side view of FIG. 6 taken along lines 7—7.
Figure 8:
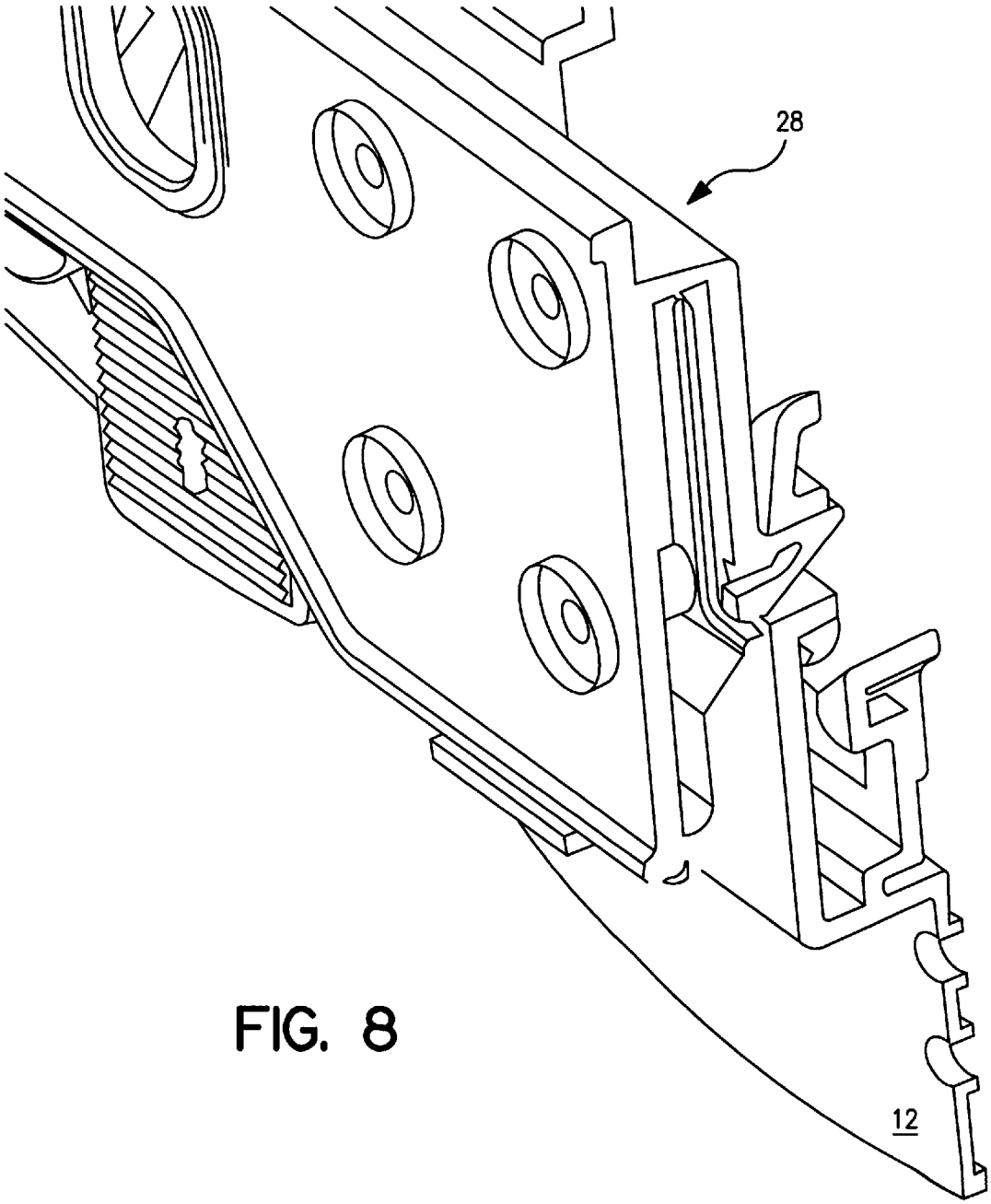
FIG. 8 is a side view of FIG. 6 taken along lines 8—8.

Referring to FIGS. 5 and 6, the catch assembly 30 is attached to the upper outside of the belt insert 10 orientated away from the wearer's back. The catch assembly 30 is located on the vertical center line of the belt insert 10 with the notch guide surfaces 34 oriented upwardly. Interior of the guide surfaces 34 is the retaining notch 36 also on the vertical center line. The left and right of the vertical center line are the catch slots 42*a* and 42*b*.

The hook 54 captures the upper edge of the catch assembly 30 in a target area that is more than twice the size of the hook 54, namely, the opposed locating surface 56 and the opposed surface of the hook 54. The catch assembly 30 is virtually flat and low profile, see FIG. 7, (½" off the belt) and is less likely to trouble a soldier during combat. Referring to FIGS. 2, 3, 5 and 6, the hook assembly 50 is located on the vertical center line of the pack frame 28 with the hook 54 and the locating surface 56 orientated downwardly. The locking fingers 58 are located on either side of the hook 54. The locking fingers 58 are anchored at their tops with the catch surfaces 60 at their bottoms and oriented 90° from the wearer's back and parallel to the ground. The hook 54 and the locating guide surface 56 terminate at their upper ends in the retaining radius R.

As a pack frame is donned, the hook 54 and the locating surface 56 strike the catch assemblies notch guide surfaces 34 and the downward force on the pack frame drives the assemblies 30 and 50 toward alignment in all three mutually perpendicular axes. To achieve a positive lock, the sides of the hook 54 reach X axis alignment with the sides of the retaining notch 36. This allows the hook 54 to descend. The sloped tops 62 of the locking fingers 58 then contact the back plate 32 flexing the locking fingers 58 backwardly permitting the hook and catch to continue to slide pass each other. As alignment in the Z axis is reached, the retaining radius R drops over the pivot radius 38. As Y axis is reached, the catch surfaces 60 align with the catch slots 42 and snap pass each other to achieve lock.

To release the pack frame it is rotated rearwardly (as with the prior art pack frames) and the retaining radius R rotates on the pivot radius 38 until the catch surfaces 60 back out of the catch slots 42. When rotated far enough rearwardly, e.g. 8° with reference to vertical (X axis), the locating surface 56 strikes the back surface of the plate 32 and releases the hook 54 off the pivot radius 38, see FIG. 9.

With the three point attachment system of the invention, referring to FIGS. 1 and 3, to improve lateral stability, the catch cups 22 align with the pack frame bumpers 64. These cups/bumpers 22/64 only need to seat and lock to one another on the vertical axis. When the backpack is balanced over the low profile assembly, the load is equally spread over all three points. This substantially reduces the load placed on the hook/catch assemblies. As the wearer leans to other side, the load is transferred off of the inside bumper/cup to the outside bumper/cup and low profile hook/catch assemblies. Because the two point load bearing of the catch/hook assemblies and outside bumper/cup do not allow the frame and belt to twist out of alignment, the system does not disconnect over a wide range of motion. It also helps the wearer balance heavy loads because the belt stays positively aligned with the backpack frame and it can be used to keep the load from swaying.

With the assembly of the invention, donning ease is also improved. If the backpack is donned while tipped to either side, the lower of the two bumpers will contact its associated cup before the hook contacts the catch assembly. The pack frame is then forced to rotate back to vertical to allow the hook catch to engage.

In practicality, fitting a wide range of waist sizes is challenging because the cord length across the bumper locations changes with the arc of the belt. A small waist will curve the belt more. This moves the cups closer together and away from the pack frame. A larger waist size does the opposite. Because the bumper/cups do not positively lock they are allowed to sympathetically slide in and out relative to the wearer's back of each other as needed. The overlap of the bumper in the cup will be less with a soldier with a small waist and more with a large diameter waist. The bumpers and cups are contoured to allowed the bumpers and cups to snap past each other and overlap when vertical alignment of the pack frame is reached.

Figure 9:
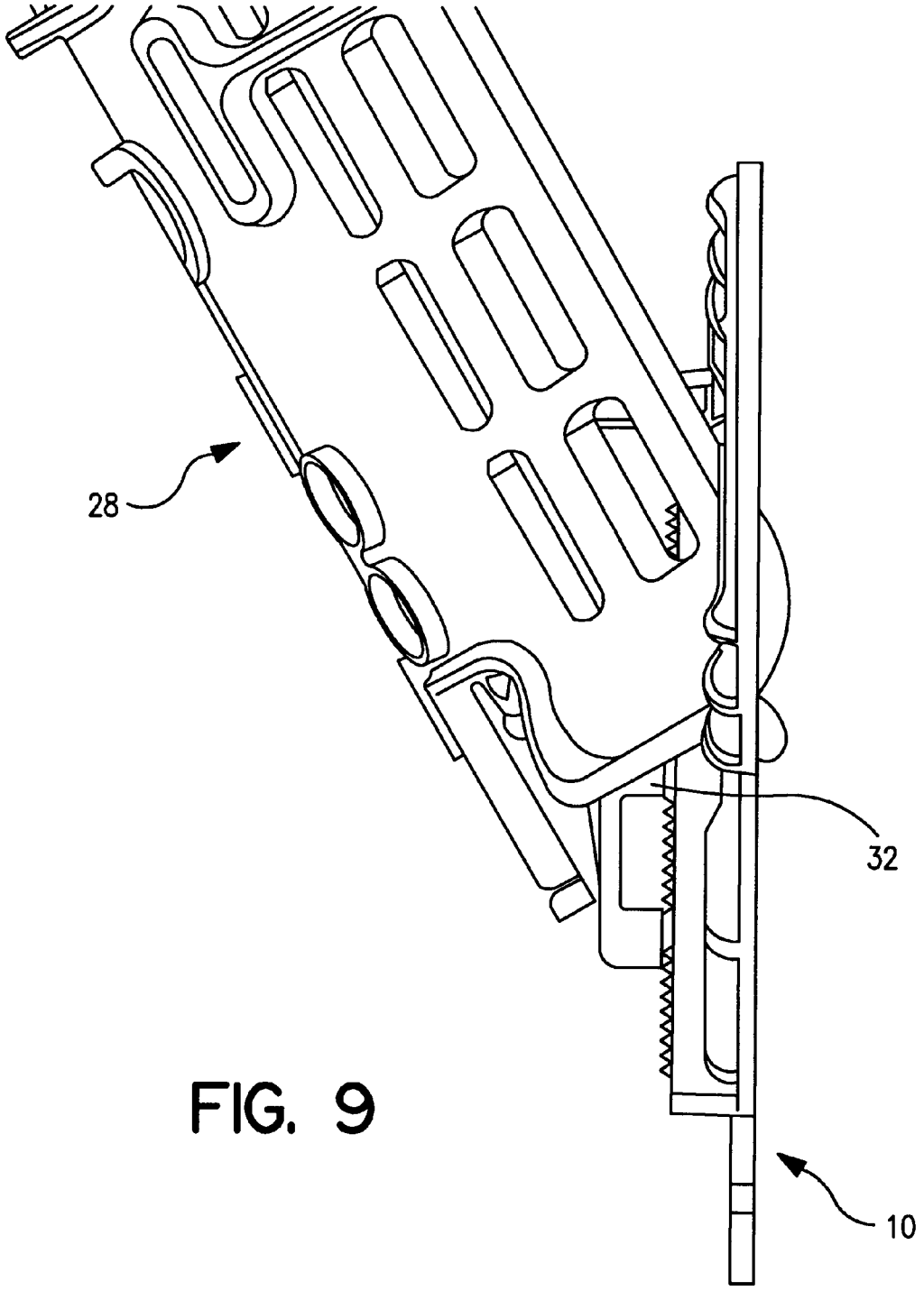
FIG. 9 illustrates the release of the hook assembly from the catch assembly.

Referring to FIGS. 3, 4 and 9, in the operation of the invention, the hook assembly 50 can enter the catch assembly 30 at any angle from about vertical to horizontal. The assemblies lock when aligned in X, Y, Z axes. Once locked, the hook assembly 50 cannot exit vertically because of the catch surfaces 60/slots 42. As will be understood, the wearer adjusts the shoulder straps maintaining the backpack in a generally flat position against the wearer's back.

When the pack frame rotates backwards a minimum of 8°, the catch surfaces 60 rotate out from under the slots 42 allowing the catch assembly 30 and hook assembly 50 to separate if pulled apart. When the frame is allowed to freely rotate 110° rearwardly, the locating surface 56 engages the back surface of the plate 32 to force the hook assembly 50 up and out from the catch assembly 30.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A low profile quick release assembly for securing and releasing a backpack frame to and from a waist belt which comprises:

a catch assembly adapted to be secured to the waist belt having an insert received therein, the catch assembly having laterally opposed guide surfaces extending downwardly and terminating in a retaining notch, a pivot radius formed in the retaining notch, and at least one catch slot formed in the assembly;

a hook assembly adapted to be secured to the backpack frame, the hook assembly comprised of a front surface and a hook, the hook being spaced apart from the front surface and defining therewith locating surfaces, said locating surfaces terminating in a retaining radius; and at least one flexible finger having a catch surface formed in the hook assembly whereby when the assemblies are engaged the retaining radius seats on the pivot radius and the catch surface engages the catch slot. when the rearward angle of the backpack exceeds a predetermined angle with reference to vertical, the assemblies disengage.

2. The assembly of claim 1 which comprises:

catch cups secured to the waist belt and bumpers secured to the backpack frame, the catch cups and bumpers in registration with one another when the catch assembly and hook assembly are aligned.

3. The assembly of claim 1 wherein the catch assembly is adapted to be secured to the insert, the insert being positioned on the upper outside of the waist belt and orientated away from the wearer's back.

4. The assembly of claim 1 wherein the catch assembly is located on the vertical center line of the waist belt with the guide surfaces orientated upwardly.

5. The assembly of claim 4 wherein the retaining notch is included on the vertical center line of the waist.

6. The assembly of claim 5 which comprises at least two catch slots, the catch slots positioned to the left and right of the vertical center line.

7. The assembly of claim 4 wherein the locating surfaces define a target area that is more than twice the size of the pivot radius of the catch assembly.

8. The assembly of claim 4 wherein the hook assembly is located on the vertical center line of the backpack frame.

9. The assembly of claim 8 which comprises at least two locking fingers, the locking fingers positioned to the left and right of the vertical center line.

10. The assembly of claim 9 wherein the catch surfaces are orientated 90° from the wearer's back and parallel to the ground.

* * * * *